US006826854B2

(12) United States Patent
Ijiri

(10) Patent No.: US 6,826,854 B2
(45) Date of Patent: Dec. 7, 2004

(54) FRICTION DEVICE FOR FOOTWEAR

(76) Inventor: Yasuhiro Ijiri, 4-28-203, Terauchi 1-chome, Toyonaka-shi, Osaka (JP), 560-0872

( * ) Notice: Subject to any disclaimer, the term of this patent is extended or adjusted under 35 U.S.C. 154(b) by 3 days.

(21) Appl. No.: 10/214,634

(22) Filed: Aug. 8, 2002

(65) Prior Publication Data

US 2003/0033735 A1 Feb. 20, 2003

(30) Foreign Application Priority Data

Aug. 20, 2001 (JP) ..... 2001-249068

(51) Int. Cl.[7] ..... A43C 13/04; A43C 15/16
(52) U.S. Cl. ..... 36/134; 36/62; 36/67 D
(58) Field of Search ..... 36/134, 59 R, 36/62, 67 R, 67 A, 67 D, 59 B

(56) References Cited

U.S. PATENT DOCUMENTS 4,633,600 A 1/1987 Dassler et al.
4,644,672 A 2/1987 Dassler et al.
5,065,534 A 11/1991 Collins

*Primary Examiner*—Anthony Stashick
(74) *Attorney, Agent, or Firm*—McGlew and Tuttle, P.C.

(57) ABSTRACT

An inner circumference side annular groove is formed in an inner circumference edge part of a golf shoe sole of a synthetic rubber, an outer circumference side annular groove is formed in the radial outside of the annular groove, and an annular packing protrusion is formed between them. An inner circumference side annular rib is provided on the lower face of the base of the friction part, an outer circumference side annular rib is provided in the outer circumference edge part thereof, and the area between them is made an annular packing face. When the friction body is fitted in and held by the holder, the inner circumference side annular rib and the outer circumference side annular rib fit in the inner circumference side annular groove and the outer circumference side annular groove, respectively, and the annular packing protrusion tightly and elastically contacts and presses the annular packing face over the entire circumference.

12 Claims, 3 Drawing Sheets

FRICTION DEVICE FOR FOOTWEAR

BACKGROUND OF THE INVENTION

1. Field of the Invention

The present invention relates to a friction device for footwear wherein a friction body such as a nonslip body to be used on footwear such as golf shoes is held on the sole of footwear by a holder being provided on the sole of footwear, and in particular, a friction device for footwear, which effectively prevents sand grains or the like from penetrating into any space between the friction body and the holder, and the friction body and the sole of footwear of said friction device for footwear.

2. Description of the Prior Art

For a nonslip body for golf shoes, which is an example of a friction body for footwear, metal and ceramic spikes have been used. In recent years, however, nonslip bodies of synthetic resins are used increasingly to prevent damages to the green, etc. and to improve the comfortableness to wear. Such nonslip bodies of synthetic resins, however, are easy to wear in comparison with metallic ones. Hence nonslip bodies of synthetic resins are provided with a fit-in protrusion, for example, a male screw of a metal or a synthetic resin, on their rear side, and the soles of the golf shoes are provided with holders, for example, holders having a female screw of a metal, which fits together with the male screw by screwing, so that the nonslip bodies can be detached and replaced as easily as possible.

However, when the nonslip body is fitted with the holder by screwing, etc. and held by the holder, if any of fine stone particles, sand grains, soil particles, lawn, dust, etc. penetrate into any space between the nonslip body and the holder, in particular, between the fit-in protrusion and the holder, it may become difficult to undo the fitting such as a screwed one, or the operation to undo the fitting may damage the holder or the friction body, or strained operation may cause injuries.

The present invention was made in view of the above-mentioned problems posed by the prior art, and one object of the present invention is to provide a friction device for footwear, which effectively prevents sand grains or the like from penetrating into any space between the friction body and the holder, any difficulties in undoing the fitting, any undoing operation of the fitting from damaging the holder or the friction body, and any strained operation from causing injuries, and to provide the friction body of said friction device for footwear.

SUMMARY OF THE INVENTION

The friction device for footwear according to the present invention comprises a friction body comprising a friction part, which is used in a state of being held on a sole of footwear to contact an object to be stepped on by the sole of footwear and generate frictional forces between itself and the object, a fit-in protrusion, which fits in and is detachably held by a holder provided on the sole of footwear, said fit-in protrusion being provided, in a condition being held on the sole of footwear, on the rear part of said friction part corresponding to the face of the sole of footwear and/or the surface part of the holder, and an annular rib or an annular groove, and an annular packing part, on said rear part of the friction part, on the outer circumference side of said fit-in protrusion, and an annular groove or an annular rib corresponding to said annular rib or annular groove, and an annular packing part corresponding to said annular packing part, on the face of the sole of footwear and/or the surface part of the holder, wherein one or both of said both annular packing parts is made of an elastic material, and that when the fit-in protrusion is fitted in and held by the holder and the friction body is held on the sole of the footwear, said annular rib fits in said annular groove, and said both annular packing parts tightly and elastically contact and press each other over the entire circumference.

The friction body according to the present invention comprises a friction part, which is used in a state of being held on a sole of footwear to contact an object to be stepped on by the sole of footwear and generate frictional forces between itself and the object, and a fit-in protrusion, which fits in and is detachably held by a holder provided on the sole of footwear, wherein said fit-in protrusion is provided, in a condition being held on the sole of footwear, on the rear part of said friction part corresponding to the face of the sole of footwear and/or the surface part of the holder, and that, of said rear part of the friction part, a part on the outer circumference side of said fit-in protrusion is provided with an annular rib or an annular groove, and an annular packing part.

The sole of footwear according to the present invention is a sole for footwear which is provided with a holder for fitting with and holding a fit-in protrusion of a friction body, said friction body comprising a friction part to be used in a state of being held on the sole of footwear to contact an object to be stepped on by the sole of footwear and generate frictional forces between itself and the object and the fit-in protrusion, wherein on the face of the sole of footwear and/or the surface part of the holder, with said holder on the sole of footwear serving as the center, an annular groove or an annular rib, and an annular packing part are provided.

When the friction body is fitted with and held by the holder, if any of fine stone particles, sand grains, soil particles, lawn, dust, etc. penetrate into any space between the friction body and the holder, in particular, between the fit-in protrusion and the holder, it may become difficult to undo the fitting between them, or the operation to undo the fitting may damage the holder or the friction body, or strained operation may cause injuries.

In the case of this friction device for footwear, the friction body and the sole of footwear, an annular rib or an annular groove, and an annular packing part are provided on the rear face of the friction part of the friction body, in such a way that one is located on the inner circumference side of the other, and in correspondence with them, an annular groove or an annular rib, and an annular packing part are provided on the face of the sole of footwear and/or the surface part (sole of footwear) of the holder, and when the fit-in protrusion is fitted in and held by the holder and the friction body is held on the sole of footwear, said annular rib fits in said annular groove, and said both annular packing parts press and contact each other tightly and elastically over the entire circumference. In other words, when the friction body has the annular rib, the sole of footwear has the annular groove, and when the friction body has the annular groove, the sole of footwear has the annular rib.

When the footwear is in the state of use, namely, the fit-in protrusion of the friction body is fitted in and held by the holder provided on the sole of footwear, and the footwear is ready to step on the ground, the annular rib of the friction body or the sole of footwear fits in the annular groove of the other, and on the inner circumference side or the outer circumference side of them, the annular packing part of the friction body tightly and elastically contacts and presses the annular packing part of the sole of footwear over the entire circumference.

As described above, the double shielding structures, namely, the fit-in structure of the annular rib and the annular groove and the sealing structure of tight and elastic contacting and pressing of both the annular packing parts over the entire circumference, effectively prevent any foreign matters such as sand grains from penetrating into any space between the friction body and the holder, irrespective of any deformations that may be generated in various parts of the friction body and the sole of footwear when the footwear is used. Furthermore, the sealing structure by tight and elastic contacting and pressing over the entire circumference between both the annular packing parts can exhibit an effect of absorbing dimensional errors to some extent while preventing penetration of foreign matters.

Said friction body may have the annular rib or the annular groove on the outer circumference side of the annular packing part (preferably in the outer circumference edge part of the friction part). In this case, the annular groove or the annular rib corresponding to the annular rib or the annular groove of the friction body is provided on the outer circumference side of the annular packing part. The annular rib or the annular groove of the friction body may be located on the inner circumference side of the annular packing part.

The friction device for footwear according to the present invention may be one wherein said friction body has an outer circumference side annular rib or annular groove and an inner circumference side annular rib or annular groove on the outer circumference side and the inner circumference side of the annular packing part, respectively, and in correspondence with these annular ribs or annular grooves, an outer circumference side annular groove or annular rib and an inner circumference side annular groove or annular rib are provided on the outer circumference side and the inner circumference side of the annular packing part, respectively, on the face of the sole of footwear and/or the surface part of the holder, and when the fit-in protrusion is fitted in and held by the holder and the friction body is held on the sole of footwear, said respective annular ribs fit in said respective annular grooves and said both annular packing parts tightly and elastically contact and press each other over the entire circumference.

The friction body of this case has the outer circumference side annular rib or annular groove and the inner circumference side annular rib or annular groove on the outer circumference side and the inner circumference side of the annular packing part, respectively. The sole of footwear has, in correspondence with these annular ribs or annular grooves, the outer circumference side annular groove or annular rib and the inner circumference side annular groove or annular rib on the outer circumference side and the inner circumference side of the annular packing part, respectively, on said face of the sole of footwear and/or the surface part of the holder.

In the case of the above-mentioned friction device for footwear, the friction body and the sole of footwear, the annular packing part is provided on the rear part of the friction part of the friction body, and the outer circumference side annular rib or annular groove and the inner circumference side annular rib or annular groove are provided on the outer circumference side and the inner circumference side of the annular packing part, respectively, and in correspondence with them, the annular packing part and, on the outer circumference side and the inner circumference side of the annular packing part, the outer circumference side annular groove or annular rib and the inner circumference side annular groove or annular rib are provided on the face of the sole of footwear and/or the surface part of the holder (sole of footwear). When the fit-in protrusion is fitted in and held by the holder and the friction body is held on the sole of footwear, said respective annular ribs fit in said respective annular grooves, and said both annular packing parts tightly and elastically contact and press each other over the entire circumference. In other words, when the annular rib is provided on the corresponding position of the friction body, the annular groove is provided on the sole of footwear, and when the annular groove is provided on the corresponding position of the friction body, the annular rib is provided on the sole of footwear.

Moreover, the friction device for footwear according to the present invention is preferably one wherein, on the rear part of the friction part of said friction body, an outer circumference side annular rib is provided on the outer circumference edge part, and on the inner side of the outer circumference side annular rib an inner circumference side annular rib is provided and with an interval in between, and the annular part between both the annular ribs is formed into an annular packing face, on the face of the sole of footwear of an elastic material, an annular packing protrusion corresponding to said annular packing face and an outer circumference side annular groove corresponding to said outer circumference side annular rib are provided, on the face of the sole of footwear and/or the surface part of the holder, an inner circumference side annular groove corresponding to said inner circumference side annular rib is provided, and when the fit-in protrusion of said friction body is fitted in and held by the holder and the friction body is held on the sole of footwear, said both annular ribs fit in said both annular grooves, respectively, and said annular packing face tightly and elastically contacts and presses said annular packing protrusion over the entire circumference almost in the direction in which the fit-in protrusion of the friction body fits in the holder.

When the footwear is in the state of use, namely, the fit-in protrusion of the friction body is fitted in and held by the holder, which is provided on the sole of footwear, and the footwear is ready to step on the ground, the annular packing part of said friction body tightly and elastically contacts and presses the annular packing part of the sole of footwear over the entire circumference, and on the outer circumference side and on the inner circumference side of them, the annular ribs of said friction body or said sole of footwear fit in the annular grooves of the other.

The triple shielding structures, namely, the fit-in structures of an annular rib and an annular groove on the outer circumference side and on the inner circumference side and the sealing structure of tight and elastic contacting and pressing, over the entire circumference, of both the annular packing parts being present between them, very effectively prevent any foreign matters such as sand grains from penetrating into any space between the friction body and the holder, irrespective of any deformations that may be generated in various parts of the friction body and the sole of footwear when the footwear is in use. The sealing structure by tight and elastic contacting and pressing over the entire circumference between said annular packing parts can also exhibit an effect of absorbing dimensional errors to some extent while preventing penetration of foreign matters.

DETAILED DESCRIPTION OF THE INVENTION

The friction device for footwear according to the present invention comprises the friction body of the present invention, which is used in a state of being held on the holder being provided on the sole of footwear, annular grooves or annular ribs, and an annular packing part all being provided on the face of the sole of footwear and/or the surface part of the holder.

Footwear within the scope of the present invention may be exemplified by sporting shoes such as golf shoes, conventional low shoes, boots and sandals, and is not limited in any way. The sole of footwear means the sole of such footwear, and its material may be exemplified by synthetic rubbers and synthetic resins. The sole of footwear may be substituted with a part of any articles other than footwear, which requires friction against the ground surface, road surface, floor surface, etc.

The friction body comprises a friction part, which contacts an object to be stepped on by the sole of footwear and generates frictional forces between itself and the object, and a fit-in protrusion, which fits in and is detachably held by a holder provided on the sole of footwear. The fit-in protrusion is provided, in a condition being held on the sole of footwear, on the rear part of said friction part corresponding to the face of the sole of footwear and/or the surface part of the holder.

The friction body can be formed of synthetic resins (For example, nylon resins such as Nylon 6/6, polyurethane resin, polypropylene resin, and acrylonitrile-butadiene-styrene copolymer resin, etc. can be used according to circumstances. For example, for a part requiring certain levels of strength and rigidity, nylon resin such as Nylon 6/6 resin may be used, and for a part requiring a certain level of elasticity or flexibility, polyurethane resin, etc. may be used.), metals, ceramics, or combinations of these materials according to circumstances.

The friction part can be formed of synthetic resins, synthetic rubbers, metals, ceramics or combinations of these materials according to circumstances, to have, as a whole, a certain level of elasticity. The frictional forces that work between the friction part and the ordinary objects of friction (for example, the ground comprising soil, gravel, stone, rock, plants, etc., road surfaces of concrete, asphalt, stone, etc., floors of concrete, synthetic resins, stone, wood, etc., snow-covered surfaces, ice-covered surfaces, etc.) can be made greater than the frictional forces that work between the sole of footwear and the ordinary objects of friction.

The friction part may comprise, for example, a base and a plurality of protrusions protruding in a height direction, which is the direction from the base to an object at the time of use. Furthermore, for example, the part that touches the object of friction may be one having a flat face, one having minute ups and downs over the entire surface or in some parts, and one having a protruding part on the side of contacting the object of friction (for example, the bottom side of the sole of footwear) such as a group of small protrusions, a group of ribs, a group of straight ribs radially arranged or a group of ribs spirally and radially arranged. The entire configuration of the friction part may be, for example, an approximately plate-shaped body having a protruding part, and preferably, an approximately disk-shaped body.

The fit-in protrusion part may be, for example, one that is made of a material such as metals and synthetic resins and is provided protrusively on the rear of the friction part. Examples of such fit-in protrusion parts include, one having a male screw part on an outer circumference part, which is to be screwed in and held in a holder having a holding hole with a female screw and being provided on a sole of footwear, and one having a fit-in and holding mechanism other than a screw (when the fit-in protrusion and the holder being provided on the sole of footwear are provided with a fit-in holding mechanism that is based on rotation of an item other than a screw or that is not based on rotation). As for the friction body, one friction body or two or more friction bodies may be held on the sole of footwear.

Said holder to be provided on the sole of footwear may be formed of synthetic resins, metals, ceramics or combination of these materials. Such a holder may be used, for example, in a state of being buried and fixed in a sole of footwear, which is made of synthetic rubbers, synthetic resins, etc. (for example, shoe sole, in particular, sporting shoe sole such as golf shoe sole). Or such a holder may be integrally formed on such a sole of footwear, be integrally formed on the base of the sole of footwear to be used in a state of being exposed on the bottom of the sole of footwear.

The friction part has, on the rear part thereof, an annular rib or an annular groove, and an annular packing part (preferably concentrically) on the outer circumference side of the fit-in protrusion, or an outer circumference side annular rib or annular groove and an inner circumference side annular rib or annular groove (preferably concentrically) on the outer circumference side and on the inner circumference side of an annular packing part, respectively. The face of the sole of footwear and/or the surface part of the holder have an annular groove(s) or an annular rib(s) that is provided in correspondence with said annular rib(s) or annular groove(s), and an annular packing part that is provided in correspondence with said annular packing part. Both, the friction part, and the face of the sole of footwear and/or the surface part of the holder may have one extra or two or more extra annular rib(s) or annular groove (s), or one extra or two or more extra annular packing part(s) (preferably concentrically), each of which has a corresponding counterpart.

The sectional configuration of each annular rib and that of the corresponding annular groove may be arranged in such a way that, for example, when the fit-in protrusion is fitted in and held by the holder and the friction body is held on the sole of footwear, the rib and the groove can fit with each other almost without any gap between them, and at least, the base of the annular rib can contact (preferably contact and press) the edge of the opening of the annular groove (for example, the annular rib has a triangular section, which is tapered on the rear side of the friction part, and the annular groove has a square section, and the base of the annular rib contacts the edge of the opening of the annular groove).

Each annular rib may have a constant sectional configuration, for example, a triangular section which is tapered almost in the direction in which the fit-in protrusion of the friction body fits in the holder. When two or more annular ribs are provided, the height and configuration of each annular rib may be identical or different. For example, the annular rib on the outer circumference side may be higher than the other. When annular ribs are provided both on the outer circumference side and the inner circumference side, the interval or radial distance between them may be, for example, the height of a rib being not higher than other (the height of the lower one or the height of ribs when they have the same height) times about 0.7 through 3, preferably, about 1 through 2.

Either one or both of the annular packing part of the friction part and the annular packing part of the face of the sole of footwear and/or the surface part of the holder is made of an elastic material (for example, a synthetic rubber material), and as for their configurations, for example, one may be an annular packing protrusion, and the other one may be an annular packing face. Or both of them may be annular packing protrusions with a trapezoidal section. Or one may be an annular packing protrusion, and the other may be an annular packing concave. In any case, when the fit-in protrusion is fitted in and held by the holder and the friction body is held on the sole of footwear, both the annular packing parts tightly and elastically contact and press each other over the entire circumference almost in the direction in which the fit-in protrusion of the friction body fits in the holder.

It is desirable that the respective annular packing parts are integrally provided on the friction body, and the face of the sole of footwear and/or the surface part of the holder. In this sense, it is desirable that the annular packing part of an elastic material (in particular, the annular packing protrusion) is integrally provided on the sole of footwear made of a synthetic rubber material.

It is desirable that the annular packing protrusion has a longitudinal section of which width gradually decreases from the base towards the end almost in the direction in which the fit-in protrusion of the friction body fits in the holder. In this case, as the width of the longitudinal section of the annular packing protrusion decreases gradually from the base towards the end, the portion of the annular packing protrusion closer to the end thereof is easy to be compressed and deformed towards the base thereof. Hence the sealing effect by the elastic contacting and pressing between the annual packing protrusion and the counterpart annular packing part (for example, an annular packing face) over the entire circumference is enhanced.

It should be noted that an annular groove or an annular rib provided on the face of the sole of footwear and/or the surface part of the holder, and the annular packing part provided on the face of the sole of footwear and/or the surface part of the holder includes an annular groove or an annular rib, and an annular packing part provided on either one of the face of the sole of footwear and the surface part of the holder, and an annular groove or an annular rib, and an annular packing part provided across both the face of the sole of footwear and the surface part of the holder (for example, on their boundary part).

It is desirable that the above-mentioned respective annular ribs, respective annular grooves and respective annular packing parts are all concentric annuli, in particular, all concentric annuli having the axis of the fit-in protrusion in a state of the friction body being fitted in and held by the holder as the center. The reason for this is that it is convenient for realizing and maintaining the fitting between the annular ribs and the annular grooves and tight and elastic contacting and pressing between both the annular packing parts over the entire circumference when the friction body can be rotated on the axis of the fit-in protrusion or when the fit-in protrusion of the friction body and the holder provided on the sole of footwear can be fitted together and detached from each other by a fitting and holding mechanism relying on rotation of screws or structures other than screws (for example, a mechanism wherein fitting is maintained by rotation of the friction body in one direction and fitting is undone by rotation of the friction body in the other direction).

It is desirable that the outer circumference side annular rib is one provided in the outer circumference edge part of the friction body. In this case, when the friction body is fitted with and held by the holder, the annular body and the annular groove fit with each other in the outer circumference edge part of the friction part, hence penetration of any foreign matter into the space between the friction body and the face of the sole of footwear and/or the surface part of the holder is prevented effectively. The outer circumference side annular rib of this case may have a constant section of a triangle, wherein the outer circumferential face is cylindrical, and the inner circumferential face is a slope and the triangle is tapered towards the rear face of the friction part. With this arrangement, when the outer circumference side annular rib and the outer circumference side annular groove fit with each other, penetration of any foreign matter into the space between the friction body and the face of the sole of footwear and/or the surface part of the holder can be prevented more effectively.

When the fit-in protrusion of the friction body and the holder provided on the sole of footwear can be fitted together or detached from each other by a fitting and holding mechanism based on rotation of screws or structures other than screws, in a condition of being fitted and held together, the annular packing part of the friction part and the annular packing part of the face of the sole of footwear and/or the surface part of the holder tightly and elastically contact and press each other over the entire circumference, and they generate a resisting force against rotation of the friction body. Accordingly, inadvertent loosening of the friction body under the fitting and holding condition and eventual undoing of the fitting can be prevented.

BRIEF DESCRIPTION OF THE DRAWINGS

FIG. 1 and FIG. 2 show sections along the line A—A of FIG. 3.

EMBODIMENTS

Some embodiments of the present invention will be described with reference to the drawings.

FIG. 1 through FIG. 6 relate to a friction device for golf shoes, its friction body and the sole of a golf shoe, as an example of embodiment of the friction device for footwear, the friction body and the sole of footwear according to the present invention. The present invention, however, is applicable to any other sporting shoes and footwear.

This friction device for footwear comprises golf shoe soles S of a synthetic rubber, holders 10 of Nylon 6/6 resin, which are fixed and held on the golf shoe soles S, and friction bodies 16 comprising a fit-in body 12 of Nylon 6/6 resin (a hard synthetic resin) and a friction part 14 of polyurethane resin (a relatively soft synthetic resin).

Figure 1:
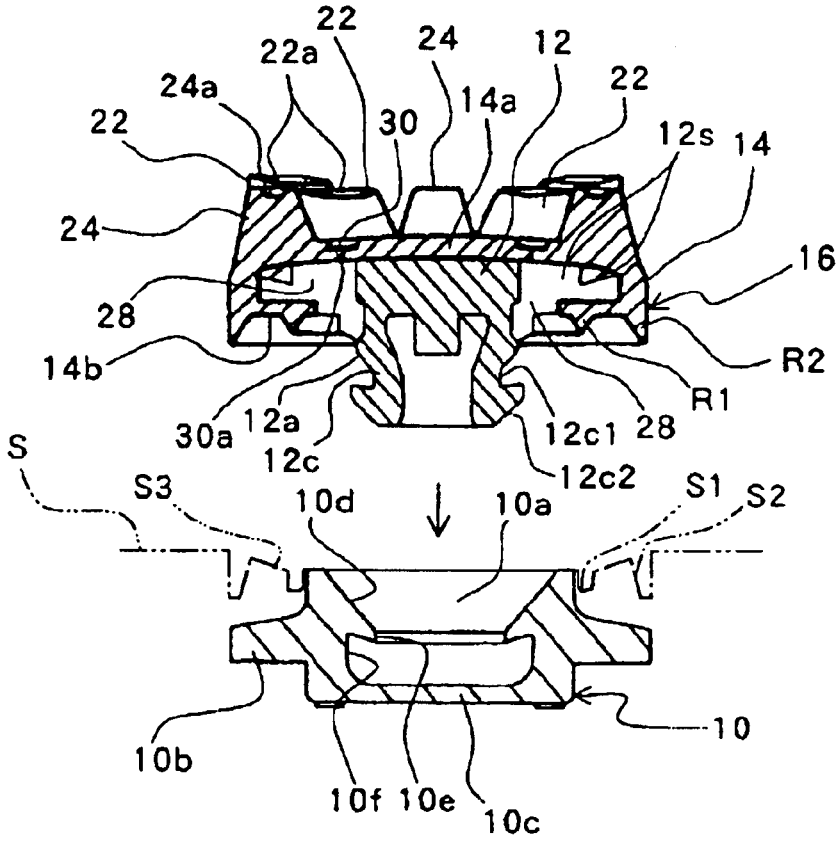
FIG. 1 is a sectional view showing the state of fitting and holding the friction body in the holder, which is provided on the sole of a golf shoe.

An annular holder side fit-in part 10*a* (fit-in concave part) is formed on the inner circumference side of the upper half of the holder 10 as shown in FIG. 1. The holder 10 has an outwardly expanding part 10*b* on the outer circumference side thereof at an intermediate position in the vertical direction. The bottom of the holder 10 is closed by an approximately flat plate part 10*c*.

The holder-side fit-in part 10*a* is rotationally symmetric along a vertical axis. Most of the upper part of the holder-side fit-in part 10*a* in FIG. 1 is composed of an inner circumferential wall 10*d*, which is in a shape of a frustum of right circular cone, of which diameter decreases downwards. The lower end of the holder-side fit-in part 10*a* is formed into an annular stopper protrusion 10*e*, which protrudes inwardly in the radial direction. The part below the stopper protrusion 10*e* in FIG. 1, namely, the lower part of the holder-side fit-in part 10*a* is expanded in diameter over the entire circumference outwardly in the radial direction and is surrounded by an annular wall 10*f*.

The holder 10 is fixed on the golf shoe sole S in such a way that only the upper end of the holder-side fit-in part 10*a* as shown in FIG. 1 is exposed and the holder 10, including its part above the outwardly expanding part 10*b*, is buried in the golf shoe sole S. The outer circumference face of the top end of the holder 10 is cylindrical, and in the inner circumferential part of the golf shoe sole S, which is on the outer circumference side of the holder 10, is formed an inner circumference side annular groove S1, which is concentric with the holder 10, opens upwards, is annular and has a square section. Furthermore, an outer circumference side annular groove S2, which is annular, opens upwards and has an approximately triangular section, is formed in the golf shoe sole S more outwardly in the radial direction than the inner circumference side annular groove S1. The outer circumference side annular groove S2 is concentric with the inner circumference side annular groove S1 and is away from the latter by a radial distance that is about 1.5 times as large as the depth of the inner circumference side annular groove S1. The outer circumferential face of the outer circumference side annular groove S2 is cylindrical, and the inner circumferential face thereof is in the shape of the outer circumferential face of a frustum of right circular cone, which tilts upward inwardly. The depth of the outer circumference side annular groove S2 is about twice as large as the depth of the inner circumference side annular groove S1.

An annular part between the inner circumference side annular groove S1 and the outer circumference side annular groove S2, which is formed integrally as a part of the golf shoe sole S, is an annular packing protrusion S3 made of a synthetic resin (an elastic material). The annular packing protrusion S3 is annular and has such a constant longitudinal section that, as shown in the longitudinal section of FIG. 1, the upper face tilts upward in the outward radial direction and the width decreases gradually from the base (the lower part in FIG. 1) towards the end (the upper part in FIG. 1), and is concentric with the inner circumference side annular groove S1 and the outer circumference side annular groove S2.

When the golf shoes are used, the up-down relationship of FIG. 1 will be reversed. The outwardly expanding part 10*b* has a function of preventing the holder 10 from being removed from the shoe sole when the holder 10 is buried and fixed in the shoe sole.

As the holder 10 is free of any movable part, it has a good durability as a whole. Hence a pair of golf shoes, of which golf shoe soles S have the holders 10 fixed in an undetachable state, can be used over a long period. Furthermore, as the holder 10 has no movable part, a material, which has excellent physical properties, including heat resistance, pressure resistance and wear resistance, can be properly selected for the holder 10. Accordingly, a material having excellent heat resistance and pressure resistance can be selected for the holder 10 when it is to be inserted in a molding material such as a synthetic resin or a synthetic rubber and subjected to molding of the golf shoe sole S.

The fit-in body 12 of the friction body 16 has, at its upper end, a disk-shaped sidewise expanding part 12*s*. The upper end of the fit-in body 12 including this sidewise expanding part 12*s* is covered with polyurethane resin (a relatively soft synthetic resin), molded and solidified to form an approximately disk-like friction part 14. Thus the friction body 16 is constituted, wherein the fit-in body 12 and the friction part 14 are integrated with each other.

Of the fit-in body 12, a part protruding downwards from the friction part 14 is the friction body side fit-in part 12*a* (fit-in protrusion). The friction body side fit-in part 12*a* comprises a pair of support pieces 12*b* and a pair of stoppers 12*c*, which are located between the support pieces 12*b* and face each other with a horizontal space in between.

The outer circumferential face 12*b*1 of the upper half of the support piece 12*b* corresponds to a part for about 120 degrees of central angle of an outer circumferential face of a frustum of right circular cone decreasing in diameter downwards. The outer circumferential face of the lower half thereof corresponds to a part for about 120 degrees of central angle of a cylinder. The inner circumferential face 10*d* of the frustum of right circular cone of the holder side fit-in part 10*a* of the holder 10 and the outer circumferential faces 12*b*1 of the upper halves of the support pieces 12*b* of the friction body side fit-in part 12*a* of the friction body 16 constitute the lateral support mechanism and the fit-in direction support mechanism.

A stopper concave 12*c*1 being in the shape of a groove, which is open outwards and is approximately in the circumferential direction, is provided at the lower end of each stopper 12*c*. The lower end outer side face 12*c*2 of the stopper 12*c* is tilted upward outwardly.

The friction part 14 has an approximately disk-shaped base 14*a* and a plurality of protrusions, which protrude in the direction of height being the direction from the base 14*a* towards the object at the time of use. The top of the base 14*a* swells upward gradually towards the center thereof.

Of the top of the base 14*a*, a part closer to the outer circumference in the radial direction (for example, from ¾ to ½, preferably about ⅔ of the radius) has a total of four radial protrusions 22, namely, one for every 90 degrees of the central angle, and a total of four intermediate height protrusions 24, each of which is located in a position halving, in the circumferential direction, the space between two adjacent radial protrusions 22. The radial protrusions 22 and the intermediate height protrusions 24 are made of polyurethane resin (a material that can relatively easily undergo elastic deformation).

Each radial protrusion 22 has the same form. It extends from a position about one third of the radius away from the center in the radial direction to the radial outer end position. The circumferential width is almost constant. Of each radial protrusion 22, a face that contacts the object at the time of use is the protrusion direction face 22*a*. The length in its radial direction (about two thirds of the length of the radius) is longer than its width in the circumferential direction. Its width in the circumferential direction is almost constant. The radial outer end of the radial protrusion 22 gradually overhangs from the base upwards as shown in FIG. 1 and outwards in the radial direction. As a result, the radial outer end of the protrusion direction face 22*a* projects radially outwards greater than the base 14*a*. On the other hand, the radial inner end of the radial protrusion 22 tilts a little upwards from the base towards the radial outside.

Each protrusion direction face 22*a* is a concaved face curving in the radial direction, and it is tilted so that its height decreases from the radial outside towards the radial inside. The protrusion direction face 22*a* is also curved and concaved in the circumferential direction. Each radial protrusion 22 is provided with a buffer groove 22*b* at the radial center position thereof and on both sides in the circumferential direction (in other words, as if penetrating in its circumferential direction). The buffer groove 22*b* has a semicircular section and opens in the protrusion direction face 22*a*.

Each intermediate height protrusion 24 is located almost in the same radial position as the buffer groove 22*b* of each radial protrusion 22. Each intermediate height protrusion 24 is in the shape of a frustum of right circular cone of which diameter decreases upwards as shown in FIG. 1. Its top end or protrusion direction end is provided with a spherical buffer concave 24*a*, which opens upwards in the protrusion direction and has a central angle of less than 180 degrees (preferably from about 20 to 160 degrees). The height of each intermediate height protrusion 24 is approximately (three tenth of the difference between the height of the radial outer end and the height of the radial inner end of the protrusion direction face 22*a* of the radial protrusion 22) plus the height of the radial inner end.

In the friction part 14, insertion parts 28 being holes in the vertical direction respectively are provided at radially outer positions of both the stoppers 12*c*. Each insertion part 28 is open in its lower part, and the upper part is closed by a closure part 30. The closure part 30 is square when seen in a plan view and is thin. It is provided, at the center, with an incision part 30*a* that penetrates vertically.

On the lower face of the base 14*a* of the friction part 14, an annular inner circumference side annular rib R1 is provided on the outer circumference side of the friction body side fit-in part 12*a*, and an annular outer circumference side annular rib R2 is provided at the outer circumference edge part of the base 14*a*. The inner circumference side annular rib R1 and the outer circumference side annular rib R2, and an annular packing face 14*b* being an annular plane between the inner circumference side annular rib R1 and the outer circumference side annular rib R2 on the rear part of the friction part 14 are arranged in such a way that, when the friction body side fit-in part 12*a* of the friction body 16 is fitted in and held by the holder 10 and the friction body 16 is held on the golf shoe sole S, the inner circumference side annular rib R1 and the outer circumference side annular rib R2 will fit in the inner circumference side annular groove S1 and the outer circumference side annular groove S2, respectively, and the annular packing protrusion S3 will elastically and tightly contact and press the annular packing face 14*b* over the entire circumference. In that case, the annular packing protrusion S3 will be elastically compressed almost in the vertical direction.

The inner circumference side annular rib R1 has a constant section of an isosceles triangle tapering downwards, and the base of the inner circumference side annular rib R1 contacts the edge of the opening (the left and right upper ends in FIG. 1) of the inner circumference side annular groove S1. The outer circumference side annular rib R2 has a constant section wherein the outer circumferential face is cylindrical, and the inner circumferential face is the outer circumferential face of a frustum of right circular cone, which tilts upward inwardly. The outer circumference side annular rib R2 fits in the outer circumference side annular groove with almost no gap between them.

Figure 2:
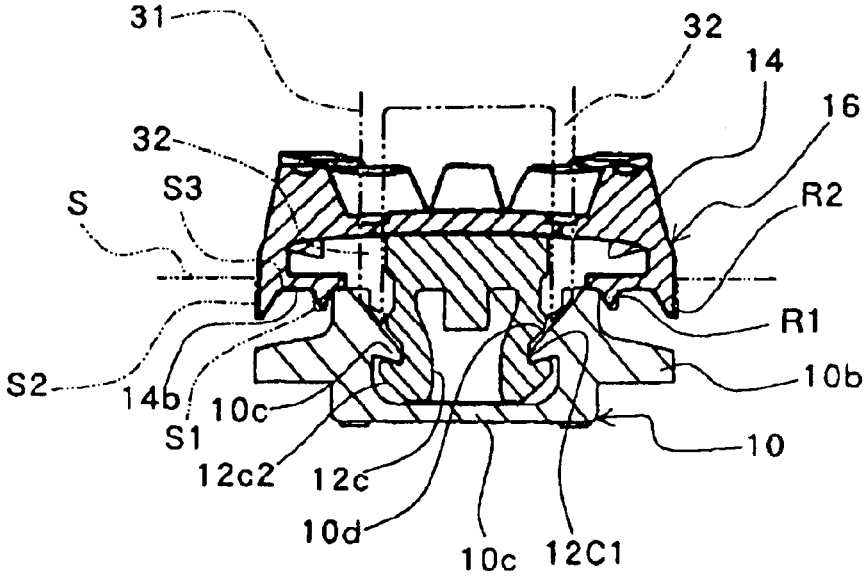
FIG. 2 is a sectional view showing that the friction body is fitted in the holder being provided on the sole of the golf shoe, and inserts of an undoing tool are being inserted into insertion parts of the friction body.
Figure 3:
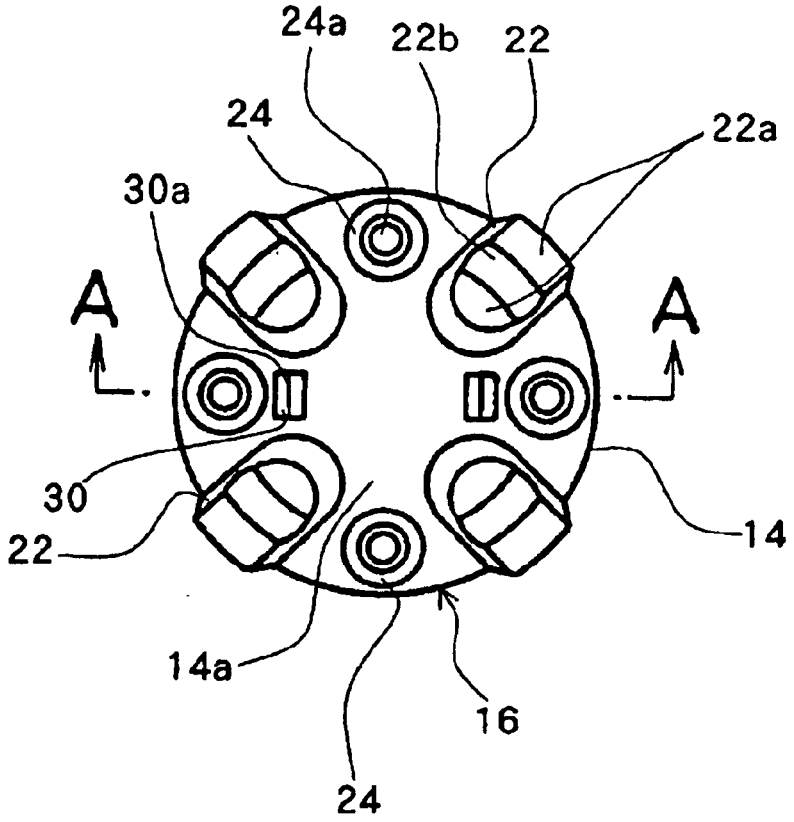
FIG. 3 is a plan view of the friction body.
Figure 4:
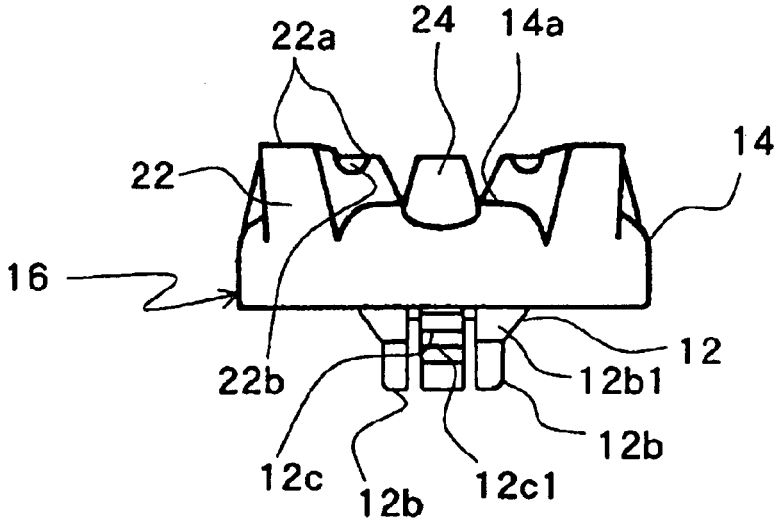
FIG. 4 is a side view of the friction body.
Figure 5:
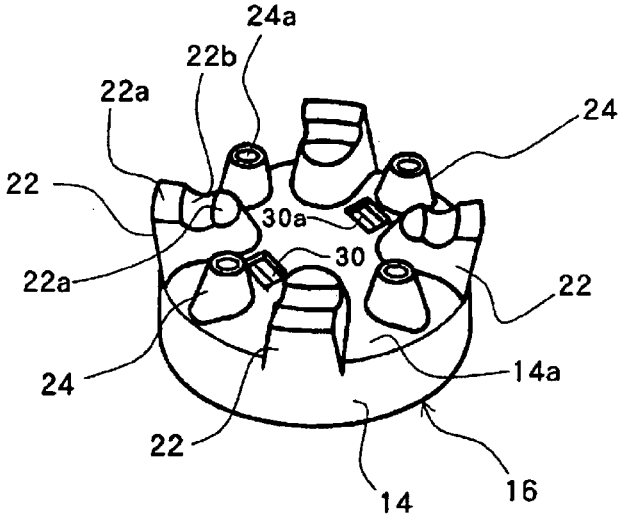
FIG. 5 is a perspective view of the friction body.
Figure 6:
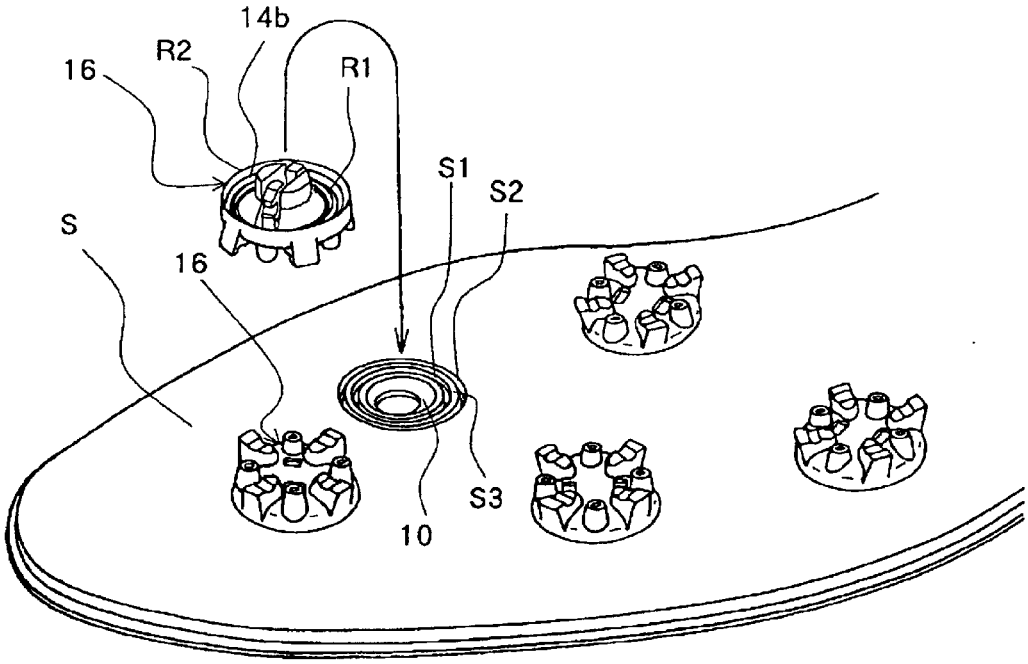
FIG. 6 is a perspective view showing the bottom side of the friction body and the holder being fixed on the sole of the golf shoe.

When the friction body side fit-in part 12*a* of the friction body 16 is fully fitted into the holder side fit-in part 10*a* of the holder 10 being buried and fixed in the golf shoe sole S (the shoe sole faces upwards in FIG. 1) in the direction shown in FIG. 1, the top end of each stopper 12*c* will be elastically flexed once towards the radial inside because, in the process of fitting, its lower end outer face 12*c*2 will be guided by the inner circumferential face 10*d*, being in the shape of a frustum of right circular cone, of the holder side fit-in part 10*a*. After that, the top end of the stopper 12*c* will restore itself towards the radial outside and, the stopper concave 12*c*1 will fit with the stopper protrusion 10*e* as shown in FIG. 2.

When the stopper concave 12*c*1 fits with the stopper protrusion 10*e*, this fitting will be maintained by the radially outward urged force of the stopper 12*c* (due to the elasticity of the stopper 12*c* itself, the stopper 12*c* generates this repulsive force and reacts against the radially inward flection). As a result, the friction body side fit-in part 12*a* is prevented from escaping upward from the holder side fit-in part 10*a*, and the friction body 16 is fixedly held in the holder 10.

Under this condition, the inner circumference side annular rib R1 and the outer circumference side annular rib R2, which are provided doubly on the rear part (the lower side in FIG. 1) of the friction part 14, fit in the inner circumference side annular groove S1 and the outer circumference side annular groove S2, which are provided doubly on the golf shoe sole S, respectively. Moreover, the annular packing protrusion S3 between the inner circumference side annular groove S1 and the outer circumference side annular groove S2 on the golf shoes sole S tightly and elastically contacts and presses, over the entire circumference, the annular packing face 14*b* between the inner circumference side annular rib R1 and the outer circumference side annular rib R2 on the rear part of the friction part 14. As a result, the shielding structure, wherein the double fit-in structures of the inner circumference side annular rib R1 and the inner circumference side annular groove S1 and the outer circumference side annular rib R2 and the outer circumference side annular groove S2 and the sealing structure by tight and elastic contacting and pressing over the entire circumference between the annular packing face 14*b* and the annular packing protrusion S3, which is provided between the double fitting structures, are concentrically arranged, very effectively prevents any foreign matters such as sand grains from penetrating into any space between the friction body 16 and the holder 10, irrespective of any deformations that may be generated in various parts of the friction body 16 and the golf shoe sole S when the footwear is used. Furthermore, the sealing structure by tight and elastic contacting and pressing over the entire circumference between the annular packing face 14*b* and the annular packing protrusion S3 can exhibit an effect of absorbing dimensional errors to some extent while preventing penetration of foreign matters.

When the outer circumferential faces 12*b*1 of the upper halves of both the support pieces 12*b* of the friction body side fit-in part 12*a* contact the inner circumferential face 10*d*, being in the shape of a frustum of right circular cone, of the holder side fit-in part 10*a*, the friction body 16 is supported by the holder 10 upward and in the radial directions. This prevents that the friction body 16 is unstably held by the holder 10 buried and fixed in the golf shoe sole S and the friction body 16 can not exhibit sufficient friction effect, that the holder side fit-in part 10*a* or the friction body side fit-in part 12*a* is damaged or worn out, and that holding of the friction body 16 by the holder 10 is undone during use and the friction body 16 comes out.

When this friction body 16 is combined with a golf shoe sole S and the holder 10 that is fixed on the golf shoe sole S and used as a friction device for footwear, as the friction part 14 of the friction body 16 is relatively soft, it contributes much to prevention of any damages to the green and floors of buildings, etc. and enhancement in comfortableness to wear. Furthermore, as the stopper concave 12*c*1 and the stopper protrusion 10*c* are made of a hard synthetic resin, it prevents that an unexpected force works during the use and undos the fitting of the stopper concave 12*c*1 and the stopper protrusion 10*e*, and that the stopper concave 12*c*1 or the stopper protrusion 10*e* wears and their fitting tends to be undone easily.

When a pair of golf shoes wherein a plurality of the friction bodies 16 are held in a plurality of the holders 10 are used, contacting and pressing on an object generally starts from the radially outer portions of the protrusion direction faces of the respective radial protrusions 22. As each radial protrusion 22 is made of a material that is relatively easy to undergo elastic deformation, the radial protrusion 22 will be compressed almost in the height direction or it will be compressed in that way and at the same time it will be bent to reduce its height, and with this, the contacting and pressing area of the protrusion direction face 22*a* against the object will expand from the radial outside to the inside. Then the remaining protrusion direction faces 22*a* of the radial protrusions 22 and the protrusion direction ends of the intermediate height protrusions 24 start contacting and pressing against the object.

As shown above, the respective radial protrusions 22 start to contact and press the object with their radial outer portions and undergo deformation to expand the contacting and pressing portions to the radial inner portions. Accordingly, when the object to be stepped on by the golf shoe sole S is a soft or easily deformable one such as a lawn or the sands, the radial protrusions 22 will not bite much into the lawn or the like and prevent the object from damage. At the same time, the radial protrusions 22 exhibit nonslip and stable supporting effects. Furthermore, the intermediate height protrusions 24, of which height is approximately (three tenth of the difference between the height of the radial outer end and the height of the radial inner end of the protrusion direction face 22*a* of the radial protrusion 22) plus the height of the radial inner end, prevent the lawn, etc. from damage and enhance the nonslip and stable supporting effects.

When the object to be stepped on by the golf shoe sole S is a relatively hard or undeformable surface such as concrete, asphalt or stone pavement, contacting and pressing on the object generally starts from the radially outer portions of the protrusion direction faces of the respective radial protrusions 22. As each radial protrusion 22 is made of a material that is relatively easy to undergo elastic deformation, the radial protrusion 22 will be compressed almost in the height direction or it will be compressed in that way and at the same time it will be bent to reduce its height, and with this, the contacting and pressing area of the protrusion direction face 22*a* against the object will expand from the radial outside to the inside. Because of this, without raising much the flexibility of the friction part 14, in other words, without raising the flexibility of the friction part 14 to such an extent that the wear resistance, durability, and nonslip and stable supporting effects for soft or easily deformable objects such as a lawn of the respective radial protrusions 22 are impaired, excellent cushioning or buffering effect is exhibited.

When portions of a certain height of the protrusion direction faces 22*a* of the radial protrusions 22, in other words, portions that are closer to the radial outside contact and press the object as described above, and the radial protrusions 22 having these portions are bent elastically to reduce their height, the remaining protrusion direction faces 22*a* of the radial protrusions 22 and the protrusion direction ends of the intermediate height protrusions 24 will start contacting and pressing against the object. Of the radial protrusions 22, portions being closer to the radial inside, and the intermediate height protrusions 24 will be deformed similarly by the contacting and pressing, to reduce their heights. However, their contacting and pressing will add to the current contacting and pressing against the object by the radially outer portions of the radial protrusions 22. Hence the cushioning effect or buffering effect will be enhanced and the resistance against deformation will be increased. This will prevent drop in durability of the protrusions and unstabilization of walking due to excessive deformation of the respective protrusions (radial protrusions 22 and intermediate height protrusions 24).

As the protrusion direction face 22*a* of the radial protrusion 22 poses a concaved surface depressed in both the radial direction and the circumferential direction, the amount of deformation that is generated when the protrusion direction face 22*a* of the radial protrusion contacts and presses the object is greater in comparison with the case wherein the protrusion direction face 22*a* is a flat surface. Because of this, the protrusion direction face 22*a* of the radial protrusion 22 has a greater effect of gripping a lawn, etc. by contacting and pressing a soft or easily deformable object such as a lawn or the sands. Thus the radial protrusion 22 does not bite much into the lawn and prevents its damage, while exhibiting enhanced nonslip and stable supporting effects. Furthermore, the amount of deformation that is generated when the protrusion direction face 22*a* of the radial protrusion 22 contacts and presses a relatively hard or undeformable object is also greater in comparison with the case wherein the protrusion direction face 22*a* is a flat surface, and the shock absorbing capability is higher.

As the buffer groove 22*b* is provided on the radial protrusion 22 at the radial center position thereof and on both sides in the circumferential direction (in other words, penetrating in its circumferential direction), said buffer groove 22*b* opening in the protrusion direction face 22*a* of the radial protrusion 22, when the radial direction face 22*a* of the radial protrusion 22 contacts and presses the object, the radial protrusion 22 will be more easily compressed almost in the height direction or it will be more easily compressed in that way and at the same time it will be more easily bent to reduce its height. Hence the protrusion direction face 22*a* of the radial protrusion 22 has a greater effect of gripping a soft or easily deformable object such as a lawn or the sands. Thus the radial protrusion 22 does not bite much into the lawn and prevents its damage, while exhibiting enhanced nonslip and stable supporting effects. Furthermore, when the protrusion direction face 22*a* of the radial protrusion 22 contacts and presses a relatively hard or undeformable object, the radial protrusion 22 will be more easily compressed almost in the height direction or it will be more easily compressed in that way and at the same time it will be more easily bent to reduce its height. Thus it will more effectively exhibit cushioning effect or buffering effect.

Furthermore, as the radial outer end of the protrusion direction face 22*a* of the radial protrusion 22 projects radially outwards beyond the base 14*a*, the radial protrusion 22 has greater nonslip and stable supporting effects on a soft or easily deformable object such as a lawn or the sands. Moreover, the radial protrusion 22 has an enhanced cushioning effect or buffering effect on a hard or undeformable object.

As the protrusion direction end of the intermediate height protrusion 24 has a buffer concave 24*a*, which opens in the protrusion direction, at the beginning of contacting and pressing against the object, the protrusion direction end of the intermediate height protrusion 24 will be more easily compressed almost in the height direction, and at the same time it will have a sucking disc effect. Thus the intermediate height protrusion 24 has an enhanced effect of gripping a lawn, etc. when it contacts and presses a soft or easily deformable object such as a lawn or sands, and the intermediate height protrusion 24 does not bite much into the lawn and prevents its damage, while exhibiting enhanced nonslip and stable supporting effects. When the intermediate height protrusion 24 contacts and presses a relatively hard or undeformable object, it will exhibit more effective cushioning or buffering effect.

Further, in each of the four radial protrusions 22 corresponding to the equal central angles in the circumferential direction of the base 14*a*, the protrusion direction face 22*a* contacts and presses the object from the radial outside to the radial inside and at the same time undergoes deformation. Thus the radial protrusions 22 exhibit the nonslip and stable supporting effects on a soft or easily deformable object such as a lawn or the sands, and also exhibit the cushioning or buffering effect. Next, the protrusion direction ends of the intermediate height protrusions 24, which are located midway between adjacent radial protrusions 22 in the circumferential direction, contact and press the object to prevent slip and support stably or exhibit the cushioning or buffering effect, and at the same time, increase the resistance to deformation and prevent excessive deformation of the respective protrusions. Accordingly, the exhibition of the nonslip and stable supporting effects, the exhibition of the cushioning or buffering effect, and the increase in resistance against deformation are positionally balanced well.

When the radial protrusions 22 and the intermediate height protrusions 24 of the friction body 16 are worn down beyond a certain level by use, then it will be necessary to replace the friction body 16 with a new one. To remove the friction body 16 from the holder 10, a pair of inserts 32 are fully inserted downwards as shown in FIG. 2, through the incision parts 30*a* of the closure part 30, into a pair of insertion parts 28. Both the inserts 32 will be guided by the inner circumferential wall 10*d* in the shape of a frustum of right circular cone to move inward and downward and press inward the outer side faces of both the stoppers 12*c* to elastically bend them inward in the radial direction. As a result, the fitting between the annular stopper protrusion 10*e* and the stopper concave 12*c*1 will be undone, and it will become possible to remove upward the friction body side fit-in part 12*a* from the holder side fit-in part 10*a* and disconnect the friction body 16 from the holder 10. In the process, as the inner circumferential wall 10*d* in the shape of a frustum of right circular cone exerts upward pushing forces to both the inserts 32 being elastically bent radially inward and both the stoppers 12*c*, the friction body 16 can be removed from the holder 10 easily together with the inserts 32 of the undoing tool 31. It should be noted that as the friction body 16 has both the insertion parts 28 and the stoppers 12*c*, irrespective of the angle of rotation of the friction body 16 in relation to the holder 10, when the inserts 32 are inserted fully into the insertion parts 28, the inserts 32 will bend the stoppers 12*c* radially inward and successfully undo the fitting between the stopper concave 12*c*1 and the stopper protrusion 10*e*.

As the upper part of each insertion part 28 is closed by the closure part 30 and the closure part 30 has only the incision part 30*a*, this arrangement can prevent, under the normal condition of use, blocking of the insertion parts with particulates, grains and pieces of sand, stone, soil, ceramics, metal, synthetic resin, wood, etc. to prevent insertion of the inserts 32 into the insertion parts 28 so as to undo the fitting and eventual removal of the friction body 16 from the holder 10, and inadvertent insertion of a variety of protrusions and any objects present on the ground or surfaces of floors, etc. into the insertion parts 28 to undo the fitting between the stopper concave 12*c*1 and the stopper protrusion 10*e*.

The undoing tool 31 is made of a synthetic resin and has a pair of inserts 32, which protrude downward in parallel to each other. Each insert 32 is a rod that can bend elastically.

It should be noted that fitting and holding of the friction body side fit-in part of the friction body by the holder being buried and fixed on the golf shoe sole can be effected by a screwing mechanism wherein the holder 10 is provided with a female screw hole and the outer circumference part of the friction body side fit-in part is provided with a male screw part, and by any fitting and holding mechanism based on rotation of a structure other than screws.

It should be noted that the dimensions, number, material, configuration, relative arrangement, etc. of parts in the description of the above-mentioned embodiments are not intended in any way to limit the scope of the present invention if not stated otherwise, and they are just examples used in the description. The description of the present invention given in Means to Solve the Problems herein including examples and numerical ranges are, in principle, applicable to the above-mentioned embodiments.

What is claimed is:

1. A friction device for footwear comprising a friction body comprising a friction part, which is used in a state of being held on a sole of footwear to contact an object to be stepped on by the sole of footwear and generate frictional forces between itself and the object, a fit-in protrusion, which fits in and is detachably held by a holder provided on the sole of footwear, said fit-in protrusion being provided, in a condition being held on the sole of footwear, on the rear part of said friction part corresponding to the face of the sole of footwear and/or the surface part of the holder, and an annular rib or an annular groove, and an annular packing part, on said rear part of the friction part, on the outer circumference side of said fit-in protrusion, said annular rib or annular groove being on the outer circumference side of the annular packing part, and an annular groove or an annular rib corresponding to said annular rib or annular groove, and an annular packing part corresponding to said annular packing part, on the face of the sole of footwear and/or the surface part of the holder, wherein the sectional configuration of each annular rib and that of the corresponding annular groove is arranged in such a way that when the fit-in protrusion is fitted in and held by the holder and the friction body is held on the sole of footware, the rib and the groove can fit with each other almost without any gap between them or at least the base of the annular rib can contact the edge of the opening of the annular groove, and one or both of said both annular packing parts is made of an elastic material, and when the fit-in protrusion is fitted in and held by the holder and the friction body is held on the sole of the footwear, said annular rib fits in said annular groove, and said both annular packing parts tightly and elastically contact and press each other over the entire circumference.

2. A friction device for footwear as recited in claim 1, wherein said friction body has an outer circumference side annular rib or annular groove and an inner circumference side annular rib or annular groove on the outer circumference side and the inner circumference side of the annular packing part, respectively, and in correspondence with these annular ribs or annular grooves, an outer circumference side annular groove or annular rib and an inner circumference side annular groove or annular rib are provided on the outer circumference side and the inner circumference side of the annular packing part, respectively, on said face of the sole of footwear and/or the surface part of the holder, and when the fit-in protrusion is fitted in and held by the holder and the friction body is held on the sole of footwear, said respective annular ribs fit in said respective annular grooves and said both annular packing parts tightly and elastically contact and press each other over the entire circumference.

3. A friction device for footwear as recited in claim 2, wherein of said annular packing part of the friction body and said annular packing part on the face of the sole of footwear and/or the surface part of the holder, one is an annular packing protrusion and the other is an annular packing face, one or both of said annular packing protrusion and said annular packing face is made of an elastic material, and when the fit-in protrusion is fitted in and held by the holder and said friction body is held on the sole of footwear, said annular packing protrusion tightly and elastically contacts and presses said annular packing face over the entire circumference almost in the direction in which the fit-in protrusion of the friction body fits in the holder.

4. A friction device for footwear as recited in claim 3, wherein on the rear part of the friction part of said friction body, an outer circumference side annular rib is provided on the outer circumference edge part, and on the inner side of the outer circumference side annular rib an inner circumference side annular rib is provided concentrically and with an interval in between, and the annular part between both the annular ribs is formed into an annular packing face, on the face of the sole of footwear of an elastic material, an annular packing protrusion corresponding to said annular packing face and an outer circumference side annular groove corresponding to said outer circumference side annular rib are provided, on the face of the sole of footwear and/or the surface part of the holder, an inner circumference side annular groove corresponding to said inner circumference side annular rib is provided, and when the fit-in protrusion of said friction body is fitted in and held by the holder and the friction body is held on the sole of footwear, said both annular ribs fit in said both annular grooves, respectively, and said annular packing face tightly and elastically contacts and presses said annular packing protrusion over the entire circumference almost in the direction in which the fit-in protrusion of the friction body fits in the holder.

5. A friction device for footwear as recited in claim 4, wherein almost in the direction in which the fit-in protrusion of the friction body fits in the holder, the width of the longitudinal section of the annular packing protrusion gradually narrows from the base towards the end.

6. A friction device for footwear as recited in claim 1, wherein the friction part comprises a base and a plurality of protrusions protruding in a height direction, which is the direction from the base to an object at the time of use.

7. A friction body comprising a friction part, which is used in a state of being held on a sole of footwear to contact an object to be stepped on by the sole of footwear and generate frictional forces between itself and the object, and a fit-in protrusion, which fits in and is detachably held by a holder provided on the sole of footwear, wherein said fit-in protrusion is provided, in a condition being held on the sole of footwear, on the rear part of said friction part corresponding to the face of the sole of footwear and/or the surface part of the holder, and of said rear part of the friction part, a part on the outer circumference side of said fit-in protrusion is provided with an annular rib or an annular groove, and an annular packing part, said annular rib or annular groove being on the outer circumference side of the annular packing part, the sectional configuration of annular rib or annular groove being arranged in such a way that when the fit-in protrusion is fitted in and held by the holder and the friction body is held on the sole of footwear, the rib or the groove being able to fit with an annular groove or an annular rib corresponding to said annular rib or annular groove on the face of the sole of footwear and/or the surface part of the holder, almost without any gap between them or at least the base of the annular rib being able to contact the edge of the opening of the annular groove, and one or both of said annular packing part and an annular packing part corresponding to said annular packing part on the face of the sole of footware and/or the surface part of the holder being made of an elastic material.

8. A friction body as recited in claim 7, wherein on the outer circumference side and on the inner circumference side of the annular packing part, an outer circumference side annular rib or annular groove and an inner circumference side annular rib or annular groove are provided, respectively.

9. A sole of footwear which is provided with a holder for fitting with and holding a fit-in protrusion of a friction body, said friction body comprising a friction part to be used in a state of being held on the sole of footwear to contact an object to be stepped on by the sole of footwear and generate frictional forces between itself and the object and the fit-in protrusion, wherein on the face of the sole of footwear and/or the surface part of the holder, with said holder on the sole of footwear serving as the center, an annular groove or an annular rib, and an annular packing part are provided, said annular groove or annular rib being on the outer circumference side of the annular packing part, the sectional configuration of annular groove or annular rib being arranged in such a way that when the fit-in protrusion is fitted in and held by the holder and the friction body is held on the sole of footwear, the groove or the rib being able to fit with an annular rib or an annular groove corresponding to said annular groove or annular rib on the rear part of said friction part, almost without any gap between them or at least the base of the annular rib being able to contact the edge of the opening of the annular groove, and one or both of said annular packing part and an annular packing part corresponding to said annular packing part on the rear part of said friction part being made of an elastic material.

10. A sole of footwear as recited in claim 9, wherein on the outer circumference side and on the inner circumference side of the annular packing part, an outer circumference side annular groove or annular rib and an inner circumference side annular groove or annular rib are provided, respectively.

11. A friction body connectable to an article of footwear, the footwear article including a receiving part, one of a footwear annular rib or annular groove arranged around the receiving part, and a footwear annular packing part arranged around the receiving part, the friction body comprising:

a fit-in protrusion mountable in the receiving part of the footwear article;

a friction part connected to said protrusion, said friction part having a footwear side facing the footwear article when said protrusion is arranged in the footwear article;

a friction annular packing part arranged on said footwear side of said friction part to elastically contact the footwear annular packing part when said protrusion is arranged in the footwear article;

one of a friction part annular rib or annular groove arranged on said footwear side of said friction part, said one friction part annular rib or groove being arranged radially outside said friction annular packing part, said one frictional part annular rib or groove having a shape substantially complementary to the other of the one footwear annular groove or rib in order to have said one frictional part annular rib or groove substantially fully contact the one other footwear annular groove or rib.

12. A friction body in accordance with claim 11, wherein:

said friction part defines an opening for insertion of a tool for unlocking said protrusion from the footwear article;

said friction part includes a flap moveable between blocking and unblocking said opening, said flap being biased toward blocking said opening.

* * * * *